US008552956B2

(12) United States Patent
Jang et al.

(10) Patent No.: US 8,552,956 B2
(45) Date of Patent: Oct. 8, 2013

(54) LIQUID CRYSTAL DISPLAY

(75) Inventors: Seungho Jang, Gumi-si (KR); Hoonseok Jang, Seoul (KR); Minsik Son, Seoul (KR); Seungpyo Seo, Daegu (KR); Juno Hur, Daegu (KR)

(73) Assignee: LG Display Co., Ltd., Seoul (KR)

( * ) Notice: Subject to any disclaimer, the term of this patent is extended or adjusted under 35 U.S.C. 154(b) by 473 days.

(21) Appl. No.: 12/461,382

(22) Filed: Aug. 10, 2009

(65) Prior Publication Data

US 2010/0123708 A1 May 20, 2010

(30) Foreign Application Priority Data

Nov. 19, 2008 (KR) ..... 10-2008-00115179

(51) Int. Cl.
*G09G 3/36* (2006.01)

(52) U.S. Cl.
USPC ..... 345/100; 345/99

(58) Field of Classification Search
USPC ..... 345/100
See application file for complete search history.

(56) References Cited

U.S. PATENT DOCUMENTS 6,115,020 A * 9/2000 Taguchi et al. ..... 345/99
2006/0279512 A1* 12/2006 Kim et al. ..... 345/100
2007/0296682 A1* 12/2007 Hwang ..... 345/100

* cited by examiner

*Primary Examiner* — Charles V Hicks
(74) *Attorney, Agent, or Firm* — McKenna Long & Aldridge, LLP

(57) ABSTRACT

A liquid crystal display is disclosed. The liquid crystal display includes a clock generator generating a first input clock signal and then a second input clock signal; a level shifter shifting the first and second input clock signals and generating clock signals whose voltages decrease stepwise from a gate high voltage, to a modulation voltage that is lower than the gate high voltage, to a gate low voltage that is lower than the modulation voltage; and a liquid crystal panel that includes data lines, gate lines intersecting the data lines, TFTs provided at intersections of the data lines and the gate lines, and a gate shift register sequentially supplying a gate pulse to the gate lines in response to the clock signals input from the level shifter.

11 Claims, 3 Drawing Sheets

LIQUID CRYSTAL DISPLAY

This application claims the benefit of Korean patent application no. 10-2008-0115179 filed on Nov. 19, 2008, which is incorporated herein by reference for all purposes as if fully set forth herein.

BACKGROUND OF THE INVENTION

1. Field

This document relates to a liquid crystal display that can modulate gate pulses with minimum clocks.

2. Discussion of the Related Art

Various types of flat panel displays having reduced weight and volume, which are drawbacks of cathode ray tubes (CTRs), are being developed. These flat panel displays include liquid crystal displays (LCDs), field emission displays (FEDs), plasma display panels (PDPs), and electroluminescence devices (ELs).

Applications of liquid crystal displays are gradually expanding thanks to their lightweight, thin, and low power consuming characteristics. Liquid crystal displays are employed in portable computers such as laptop computers, office equipment, audio/video apparatuses, indoor/outdoor advertising devices, etc. A liquid crystal display displays an image by controlling electric fields applied across liquid crystal cells to modulate light emitted from a backlight unit.

A voltage applied across liquid crystal cells in an active matrix type LCD is affected by a kickback voltage (or feed through voltage, ΔVp) that occurs due to parasitic capacitance of a TFT (Thin Film Transistor). The kickback voltage (ΔVp) is as shown in Equation 1:

$$\Delta Vp = \frac{Cgd}{Clc + Cst + Cgd}(Von - Voff) \quad \text{[Equation 1]}$$

Here, 'Cgd' refers to parasitic capacitance between the gate terminal of a TFT connected to a gate line and the drain terminal of a TFT connected to a pixel electrode of a liquid crystal cell, and 'Von-Voff' refers to a difference between a gate-high voltage and a gate-low voltage of a gate pulse applied to a gate line.

The kickback voltage varies the voltage applied to a pixel electrode of a liquid crystal cell, causing flickering and image sticking in a displayed image.

SUMMARY OF THE INVENTION

In an aspect, there is provided a liquid crystal display that can modulate gate pulses with minimum clocks and reduce flickering and image sticking.

In an aspect, there is provided a liquid crystal display including a clock generator generating a first input clock signal and then a second input clock signal; a level shifter shifting the first and second input clock signals and generating clock signals whose voltages decrease stepwise from a gate high voltage, to a modulation voltage that is lower than the gate high voltage, to a gate low voltage that is lower than the modulation voltage; and a liquid crystal panel that includes data lines, gate lines intersecting the data lines, TFTs provided at intersections of the data lines and the gate lines, and a gate shift register sequentially supplying a gate pulse to the gate lines in response to the clock signals input from the level shifter.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Other objectives, features and advantages will be made apparent by the following description and the accompanying drawings.

Hereinafter, exemplary embodiments will be described in detail with reference to FIGS. 1 to 3.

Figure 1:
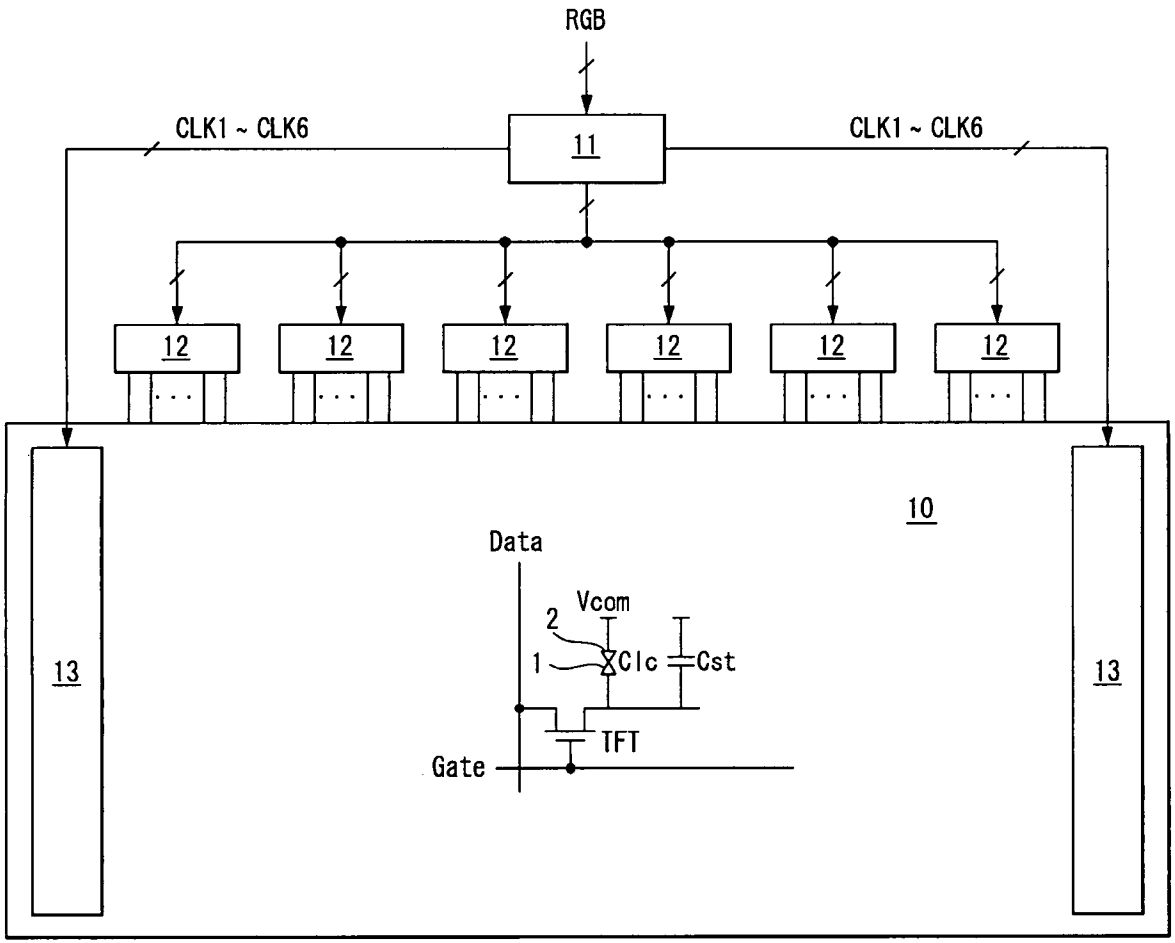
FIG. 1 is a block diagram illustrating a liquid crystal display according to an exemplary embodiment.

Referring to FIG. 1, a liquid crystal display according to an exemplary embodiment includes an LCD panel 10, a control board 11, and a plurality of source drive ICs 12. A backlight unit directing light toward the LCD panel and its driving circuit have been omitted from FIG. 2.

The LCD panel 10 includes a liquid crystal layer arranged between two sheets of glass substrates. Liquid crystal cells of the LCD panel 10 are arranged in a matrix pattern where data lines intersect gate lines.

A pixel array is formed on the lower glass substrate of the LCD panel 10. The pixel array includes data lines, gate lines intersecting the data lines, TFTs located at each intersection of a data line and a gate line, liquid crystal cells Clc connected to the TFTs to be driven by electric fields between pixel electrodes 1 and a common electrode 2, and a storage capacitor Cst. Further, the lower glass substrate of the LCD panel 10 includes gate shift registers 13 connected to the gate lines of the pixel array.

The gate shift register 13 is formed on the lower glass substrate along with the pixel array in the process of manufacturing the pixel array. The gate shift register 13 shifts a gate start pulse from the control board 11 in response to modulated clock pulses CLK1 to CLK6, and sequentially supplies the modulated gate start pulse to the gate lines.

A black matrix, a color filter, and a common electrode 2 are arranged on the upper glass substrate of the LCD panel 10. The common electrode 2 is formed on the upper glass substrate to implement a vertical electric field driving method such as a twisted nematic (TN) mode and a vertical alignment (VA) mode, and on the lower glass substrate along with the pixel electrode I to implement a horizontal electric field driving method such as an in-plane switching (IPS) mode and a fringe field switching (FFS) mode. A polarizing plate whose optical axes intersect each other is attached to the upper glass substrate and the lower glass substrate of the LCD panel 10, and an alignment film is provided at an interface with the liquid crystal layer to set up a pre-tilt angle of liquid crystal molecules.

The control board 11 includes a timing controller and a level shifter. The timing controller aligns digital video data (RGB) and supplies them to the source drive ICs 12. The timing controller generates a source timing control signal to control operation timing of the source drive ICs 12. The timing controller includes a clock generation circuit that generates first and second clock signals MCLK and GCLK for controlling the level shifter and a gate start pulse that will be input to the gate shift register 13. The level shifter sequentially generates the clock signals CLK1 to CLK6 whose voltages are decreased stepwise at falling edges in response to the first and second clock signals MCLK and GCLK from the timing controller. The clock signals CLK1 to CLK6 are supplied to the gate shift register 13 formed on the lower glass substrate of the LCD panel 10. The level shifter will be described in detail with reference to FIGS. 2 and 3.

The source drive ICs 12 receive the digital video data RGB from the timing controller, convert the digital video data RGB into analogue data voltages in response to a source timing control signal from the timing controller, and then supply the analogue data voltages to the data lines of the LCD panel 10 in synchronization with the gate pulse.

The liquid crystal display according to the exemplary embodiment provides the gate shift register on the lower glass substrate of the LCD panel 10 to simplify the gate driving circuit connected to the LCD panel 10. Further, the liquid crystal display according to the exemplary embodiment decreases 'Von-Voff' in Equation 1 by modulating stepwise the falling-edge voltage of the gate pulse supplied to the gate shift register 13 with only two clock signals, which will be described later, so that it may compensate for a kickback voltage to lessen flickering and image sticking.

Figure 2:
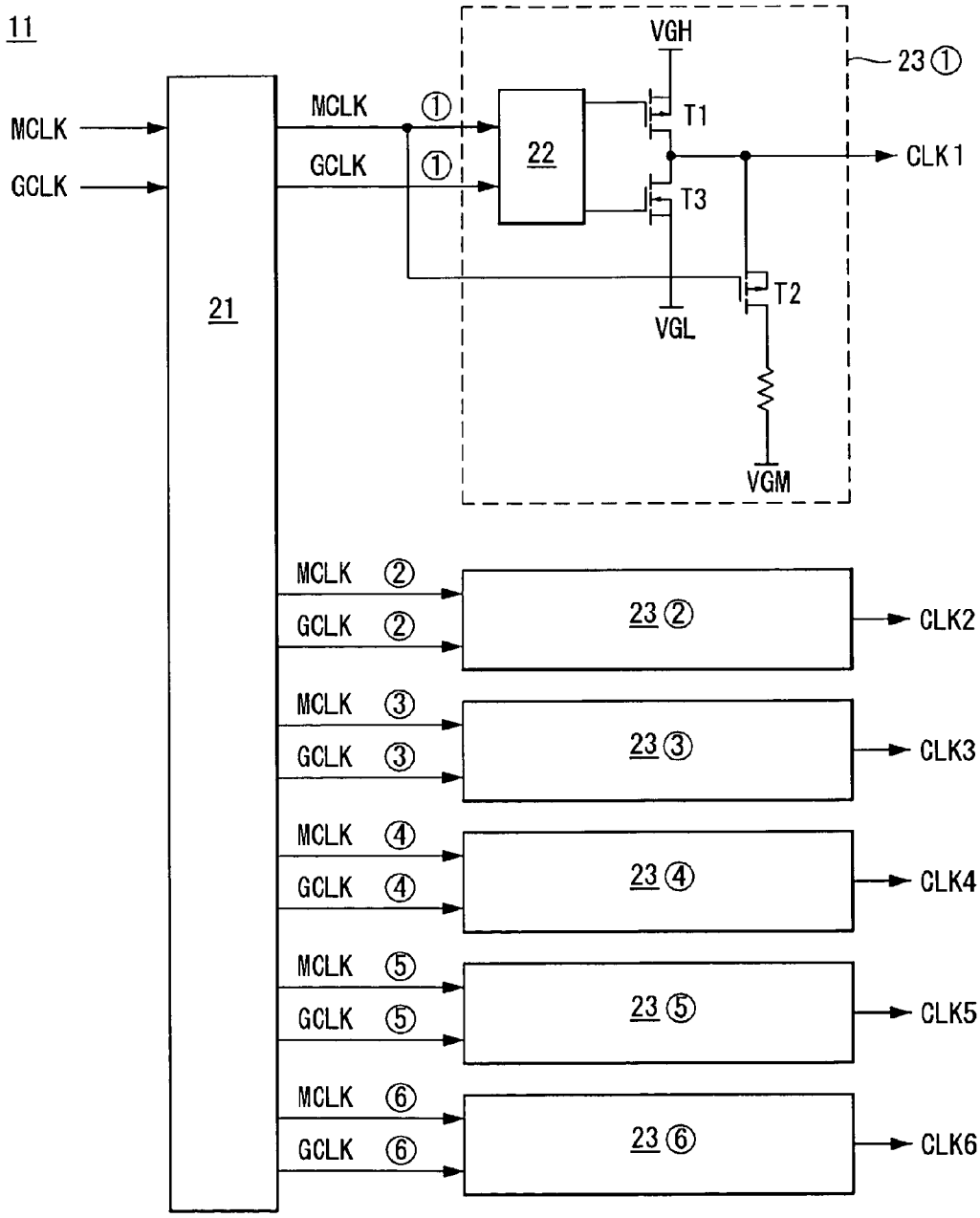
FIG. 2 is a circuit diagram illustrating in detail a level shifter of the control board shown in FIG. 1.

FIG. 2 is a circuit diagram illustrating in detail the level shifter of the control board 11. FIG. 3 is a waveform diagram illustrating waveforms input/output to/from the level shifter shown in FIG. 2.

Figure 3:
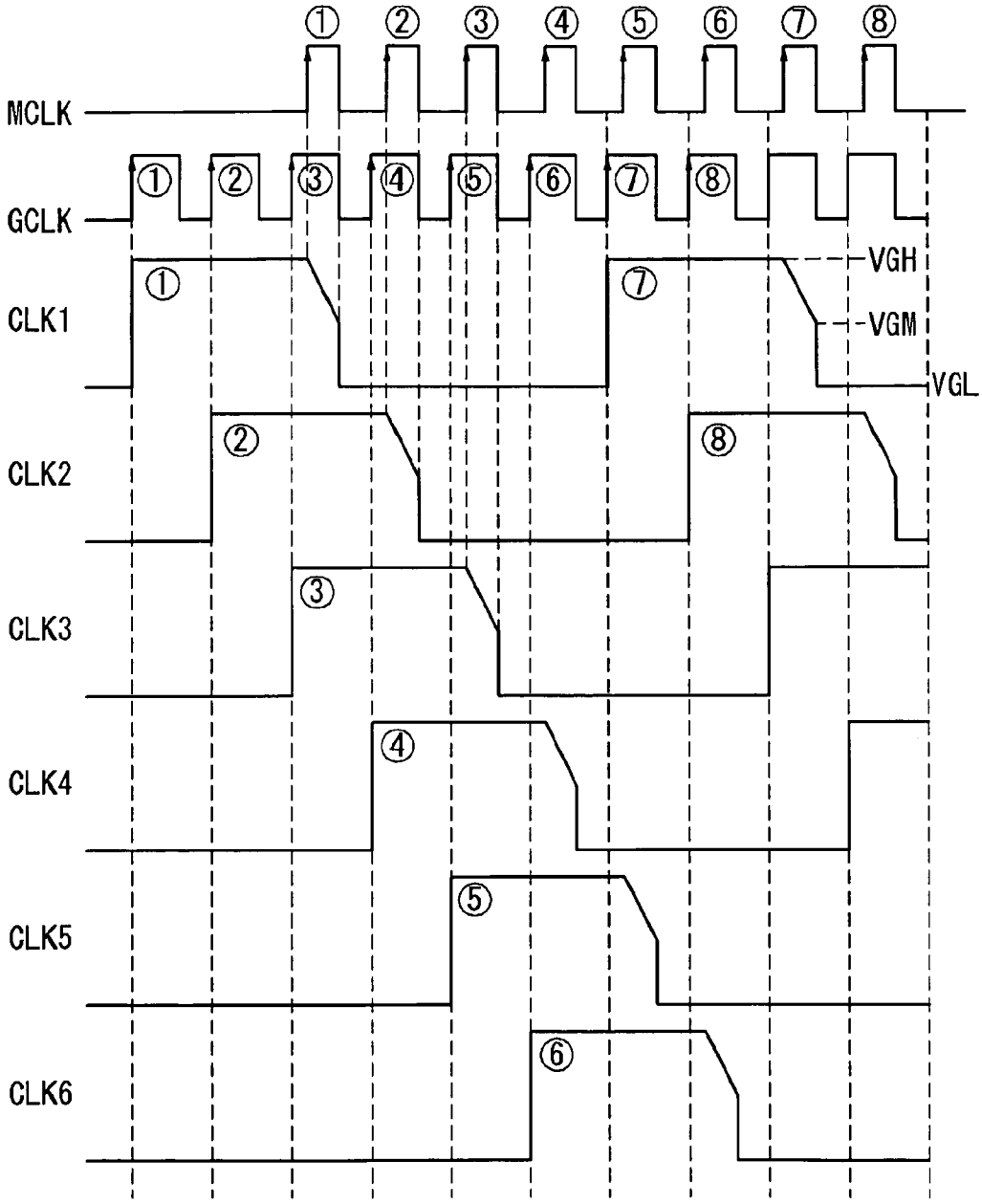
FIG. 3 is a waveform diagram illustrating waveforms input/output to/from the level shifter shown in FIG. 2.

Referring to FIGS. 2 and 3, the level shifter includes a shift register 21 and a plurality of modulation control circuits 23.

The timing controller generates a first clock signal GCLK and then a second clock signal MCLK delayed a predetermined time from the first clock signal GCLK. The rising time of the first clock signal GCLK is substantially synchronous with the rising times of the clock signals CLK1 to CLK6 output from the level shifter, and the falling time of the first clock signal GCLK is substantially synchronous with the falling time of the second clock signal MCLK. The pulse width of the first clock signal GCLK is set to be greater than the pulse width of the second clock signal MCLK. The period of the first clock signal GCLK is substantially equal to the period of the second clock signal MCLK.

The shift register 21 shifts the first clock signal GCLK and the second clock signal MCLK and sequentially supplies the first clock signal GCLK and the second clock signal MCLK to first to sixth output channel pairs as shown in FIG. 3.

A clock input terminal pair of each modulation control circuit 23① to 23⑥ is connected to an output channel pair of the shift register 21 in a one-to-one manner. The first clock signals GCLK① to GCLK⑥ are input to the first clock input terminal of the modulation control circuits 23, and the second clock signals MCLK① to MCLK⑥ are input to the second clock input terminal of the modulation control circuits 23. The modulation control circuits 23 generate the respective clock signal CLK1 to CLK6 to be supplied to the gate shift register 13 in synchronization with a rising edge of the first clock signals GCLK① to GCLK⑥ as a gate high voltage level VGH. After a predetermined time, the modulation control circuits 23 lower the voltage of the clock signals CLK1 to CLK6 to be supplied to the gate shift register 13 to a modulation voltage level VGM in synchronization with a rising edge of the second clock signals MCLK① to MCLK⑥. The modulation control circuits 23① to 23⑥ lower the voltage level of the clock signals CLK1 to CLK6 to be supplied to the gate shift register 13 to the gate low voltage level VGL in synchronization with a falling edge of the first clock signals GCLK① to GCLK⑥ and the second clock signals MCLK① to MCLK⑥. Accordingly, the modulation control circuits 23① to 23⑥ generate the clock signals CLK1 to CLK6 to be supplied to the gate shift register 13 in response to the first clock signals GCLK① to GCLK⑥ and the second clock signals MCLK① to MCLK⑥ that are sequentially input from the shift register 21, and gradually lower the falling edge voltages of the clock signals CLK1 to CLK6 to the gate high voltage level VGH, the modulation voltage level VGM, and finally the gate low voltage level VGL.

The gate high voltage VGH is equal to or higher than the threshold voltage of the TFTs formed at the pixel array of the LCD panel 10, and the gate low voltage VGL is lower than the threshold voltage of the TFTs formed at the pixel array of the LCD panel 10. The modulation voltage VGM is between the gate high voltage VGH and the gate low voltage VGL.

Each of the modulation control circuits 23① to 23⑥ includes a logic unit 22 and first to third transistors T1 to T3. The first and second transistors T1 and T2 are implemented as r-type MOS (Metal Oxide Semiconductor) TFTs, and the third transistor T3 is implemented as a p-type MOS TFT.

The logic unit 22 turns on the first TFT Ti at a rising edge of the first clock signals GCLK① to GCLK⑥ by using a delay element such as a D-flip-flop and logic gate elements that perform the logic operation of the first clock signal GCLK and the second clock signal MCLK, and then turns on the second TFT T2 at a rising edge of the second clock signals MCLK① to MCLK⑥. Subsequently, the logic unit 22 turns on the third TFT T3 at a falling edge of the second clock signals MCLK① to MCLK⑥.

The first TFT T1 outputs the gate high voltage VGH to an output terminal in synchronization with a rising edge of the first clock signals GCLK① to GCLK⑥ under control of the logic unit 22 and maintains output of the gate high voltage VGH until just before a rising edge of the second clock signals MCLK① to MCLK⑥. For this purpose, the gate electrode of the first TFT T1 is connected to a first output terminal of the logic unit 22 to which the control pulse of high logic voltage is output from the logic unit 22. The source electrode of the first TFT T1 is connected to the source of the gate high voltage VGH and the drain electrode of the first TFT T1 is connected to the output terminal of the modulation control circuits 23① to 23⑥.

The second TFT T2 outputs the modulation voltage VGM to the output terminal in synchronization with a rising edge of the second clock signals MCLK□ to MCLK□ and maintains output of the modulation voltage VGM up to a falling edge of the second clock signal MCLK□ to MCLK□. For this purpose, the gate electrode of the second TFT T2 is connected to the output terminal of the second clock signals MCLK□ to MCLK□ of the shift register 21. The source electrode of the second TFT T2 is connected to the source of the modulation voltage VGM and the drain electrode of the second TFT T2 is connected to the output terminal of the modulation control circuits 23□ to 23□.

The third TFT T3 outputs the gate low voltage VGL to the output terminal in synchronization with a falling edge of the first clock signals GCLK□ to GCLK□ and the second clock signals MCLK□ to MCLK□ under control of the logic unit 22, and maintains output of the gate low voltage VGL until the subsequent first clock signal GCLK□ to GCLK□ is input. For this purpose, the gate electrode of the third TFT T3 is connected to the second output terminal of the logic unit 22 from which the control pulse of the low logic voltage is output. The source electrode of the third TFT T3 is connected to the source of the gate low voltage VGL, and the drain electrode of the third TFT T3 is connected to the output terminal of the modulation control circuits 23□ to 23□.

The first modulation control circuit 23□ generates the output signal CLK1 of the gate high voltage VGH in synchronization with a rising edge of (6k+1)th clocks GCLK□ and GCLK□ of the first clock signal GCLK (where, k is a positive integer), and then lowers the voltage of the output signal CLK1 to the modulation voltage VGM at a rising edge of (6k+1)th clocks MCLK□ and MCLK□ of the second clock signal MCLK. And, the first modulation control circuit 23□ lowers the voltage of the output signal CLK1 to the gate low voltage VGL at a falling edge of the (6k+1)th clocks MCLK□ and MCLK□ of the second clock signal MCLK.

The second modulation control circuit 23□ generates the output signal CLK2 of the gate high voltage level VGH in synchronization with a rising edge of (6k+2)th clocks GCLK□ and GCLK□ of the first clock signal GCLK, and then lowers the voltage level of the output signal CLK2 to the modulation voltage VGM at a rising edge of (6k+2)th clocks MCLK□ and MCLK□ of the second clock signal MCLK. And, the second modulation control circuit 23□ lowers the voltage of the output signal CLK2 to the gate low voltage VGL at a falling edge of the (6k+2)th clocks MCLK□ and MCLK□ of the second clock signal MCLK. The second modulation control circuit 23□ generates the output signal CLK2 later than the output signal CLK1 of the first modulation control circuit 23□ since the clock signals GCLK□ and MCLK□ input from the shift register 21 are later than the clock signals GCLK□ and MCLKL□ input to the first modulation control circuit 23□. The output signal CLK2 of the second modulation control circuit 23□partially overlaps the output signal CLK1 of the first modulation control circuit 23□.

The third modulation control circuit 23□ generates an output signal CLK3 of the gate high voltage VGH in synchronization with a rising edge of (6k+3)th clocks GCLK□ and GCLK□ of the first clock signal GCLK, and then lowers the voltage of the output signal CLK3 to the modulation voltage VGM at a rising edge of (6k+3)th clocks MCLK□ and MCLK□ of the second clock signal MCLK. And, the third modulation control circuit 23 0 lowers the voltage of the output signal CLK3 to the gate low voltage VGL in synchronization with a falling edge of (6k+3)th clocks MCLK□ and MCLK□ of the second clock signal MCLK. Since the clock signals GCLK□ and MCLK□ input from the shift register 21 are later than the clock signals GCLK□ and MCLK□ input to the second modulation control circuit 23□, the third modulation control circuit 23□ generates an output signal CLK3 that is later than the output signal CLK2 of the second modulation control circuit 23□. The output signal CLK3 of the third modulation control circuit 23□ partially overlaps the output signal CLK2 of the second modulation control circuit 23□.

The fourth modulation control circuit 23□ generates an output signal CLK4 of the gate high voltage VGH in synchronization with a rising edge of (6k+4)th clocks GCLK□ and GCLK□ of the first clock signal GCLK, and then lowers the voltage of the output signal CLK4 to the modulation voltage VGM at a rising edge of (6k+4)th clocks MCLK□ and MCLK□ of the second clock signal MCLK. And, the fourth modulation control circuit 23□ lowers the voltage of the output signal CLK4 to the gate low voltage VGL in synchronization with a falling edge of the (6k+4)th clocks MCLK□ and MCLK□ of the second clock signal MCLK. Since the clock signals GCLK□ and MCLK□ input from the shift register 21 are later than the clock signals GCLK□ and MCLK□ input to the third modulation control circuit 23□, the fourth modulation control circuit 23□ generates an output signal CLK4 that is later than the output signal CLK3 of the third modulation control circuit 23□. The output signal CLK4 of the fourth modulation control circuit 23□ partially overlaps the output signal CLK3 of the third modulation control circuit 23□.

The fifth modulation control circuit 23□ generates an output signal CLK5 of the gate high voltage VGH in synchronization with a rising edge of (6k+5)th clocks GCLK□ and GCLK□ of the first clock signal GCLK, and then lowers the voltage of the output signal CLK5 to the modulation voltage VGM at a rising edge of (6k+5)th clocks MCLK□ and MCLK□ of the second clock signal MCLK. And, the fifth modulation control circuit 23□ lowers the voltage of the output signal CLK5 to the gate low voltage VGL in synchronization with a falling edge of the (6k+5)th clocks MCLK□ and MCLK□ of the second clock signal MCLK. Since the clock signals GCLK□ and MCLK□ input from the shift register 21 are later than the clock signals GCLK□ and MCLK□ input to the fourth modulation control circuit 23□, the fifth modulation control circuit 23□ generates an output signal CLK5 that is later than the output signal CLK4 of the fourth modulation control circuit 23□. The output signal CLK5 of the fifth modulation control circuit 23□ partially overlaps the output signal CLK4 of the fourth modulation control circuit 23□.

The sixth modulation control circuit 23□ generates an output signal CLK6 of the gate high voltage VGH in synchronization with a rising edge of (6k+6)th clocks GCLK□ and GCLK□ of the first clock signal GCLK, and then lowers the voltage of the output signal CLK6 to the modulation voltage VGM at a rising edge of (6k+6)th clocks MCLK□ and MCLK□ of the second clock signal MCLK. And, the sixth modulation control circuit 23□ lowers the voltage of the output signal CLK6 to the gate low voltage VGL in synchronization with a falling edge of the (6k+6)th clocks MCLK□ and MCLK□ of the second clock signal MCLK. Since the clock signals GCLK□ and MCLK□ input from the shift register 21 are later than the clock signals GCLK□ and MCLK□ input to the fifth modulation control circuit 23□, the sixth modulation control circuit 23□ generates an output signal CLK6 that is later than the output signal CLK5 of the fifth modulation control circuit 23□. The output signal CLK6 of the sixth modulation control circuit 23□ partially overlaps the output signal CLK5 of the fifth modulation control circuit 23□.

The liquid crystal display according to an exemplary embodiment may control the time difference of the first and second clock signals GCLK□ to GCLK□ and MCLK□ to MCLK□ to adjust the pulse width of the clock signals CLK1 to CLK6 input to the gate shift register 13. Further, the liquid crystal display according to an exemplary embodiment may adjust the pulse width and duty ratio of the second clock signals GCLK□ to GCLK□ and MCLK□ to MCLK□ to adjust the duration of the modulation voltage VGM at a falling edge of the clock signals CLK1 to CLK6 input to the gate shift register 13.

The gate shift register 13 may shift the gate start pulse to control the falling edges of the gate pulse supplied to the gate lines of the pixel array in steps of VGH, VGM, and VGL, in response to the clock signals CLK1 to CLK6 supplied from the level shifter, to have a waveform such as shown in FIG. 3.

As described above, the liquid crystal display according to the exemplary embodiments may generate output clock signals CLK1 to CLK6 whose falling edges fall stepwise with only two input clock signals GCLK□ to GCLK□ and MCLK□ to MCLK□, and supply the output clock signals CLK1 to CLK6 to the gate shift register 13 provided at the LCD panel 10 to control the falling edges of the gate pulse supplied to the gate lines stepwise. As a consequence, the liquid crystal display according to the exemplary embodiments may improve display quality by reducing flickering and image sticking, minimize clock signals, and simplify the configuration of the level shifter circuit generating clock signals supplied to the gate shift register 13.

Embodiments of the invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A liquid crystal display comprising:

a control board including a clock generator generating a first input clock signal and then a second input clock signal, and a level shifter shifting the first and second input clock signals and generating clock signals whose voltages decrease stepwise from a gate high voltage, to a modulation voltage that is lower than the gate high voltage, to a gate low voltage that is lower than the modulation voltage; and a liquid crystal panel that includes data lines, gate lines intersecting the data lines, TFTs provided at intersections of the data lines and the gate lines, and a gate shift register sequentially supplying a gate pulse to the gate lines in response to the clock signals input from the level shifter, wherein the level shifter comprises:

a shift register configured to shift the first and second input clock signals; and a modulation control circuit configured to generate the clock signal which is supplied to the gate shift register, wherein the clock signal is generated as the gate high voltage in synchronization with a rising edge of the first input clock signal, the gate high voltage of the clock signal is lowered to the modulation voltage in synchronization with a rising edge of the second input clock signal, and the modulation voltage of the clock signal is lowered to the gate low voltage in synchronization with a falling edge of the first input clock signal and a falling edge of the second input clock signal, and wherein a pulse width of the first input clock signal is set to be greater than that of the second input clock signal.

2. The liquid crystal display of claim 1, wherein the modulation control circuit comprises:

a first transistor to which the gate high voltage is supplied;

a second transistor to which the modulation voltage is supplied;

a third transistor to which the gate low voltage is supplied; and a logic unit sequentially turning on the first to third transistors in response to clock signals input from the shift register.

3. The liquid crystal display of claim 2, wherein the first transistor outputs the gate high voltage to an output terminal to be synchronized with a rising edge of the first input clock signal input to the logic unit via the shift register under control of the logic unit, and maintains output of the gate high voltage until just prior to a rising edge of the second input clock signal input to the logic unit via the shift register.

4. The liquid crystal display of claim 3, wherein the second transistor outputs the modulation voltage to the output terminal in synchronization with a rising edge of the second input clock signal input to the logic unit via the shift register, and maintains output of the modulation voltage up to a falling edge of the second input clock signal.

5. The liquid crystal display of claim 4, wherein the third transistor outputs the gate low voltage to the output terminal in synchronization with a falling edge of the first and second input clock signals input to the logic unit via the shift register under control of the logic unit, and maintains output of the gate low voltage until a subsequent first input clock signal is input.

6. The liquid crystal display of claim 5, wherein the first transistor comprises:

a gate electrode connected to a first output terminal of the logic unit;

a source electrode connected to a first voltage source that generates the gate high voltage; and a drain electrode connected to the output terminal of the modulation control circuit.

7. The liquid crystal display of claim 6, wherein the second transistor comprises:

a gate electrode connected to the output terminal of a first clock signal of the shift register;

a source electrode connected to a second voltage source that generates the modulation voltage; and a drain electrode connected to the output terminal of the modulation control circuit.

8. The liquid crystal display of claim 7, wherein the third transistor comprises:

a gate electrode connected to a second output terminal of the logic unit;

a source electrode connected to a third voltage source that generates the gate low voltage; and a drain electrode connected to the output terminal of the modulation control circuit.

9. The liquid crystal display of claim 1, wherein the second input clock signal is delayed a predetermined time from the first input clock signal.

10. The liquid crystal display of claim 1, wherein the second input clock signal is generated after at least two first input clock signals are generated.

11. The liquid crystal display of claim 1, wherein the modulation voltage of the clock signal is decreased in linear.

* * * * *